United States Patent [19]

Porte et al.

[11] 3,971,593

[45] July 27, 1976

[54] METHOD OF EXTRACTION OF NODULAR SEDIMENTS OR THE LIKE FROM THE SEA FLOOR AND AN INSTALLATION FOR CARRYING

[75] Inventors: Robert Porte, Le Mesnil-St. Denis; Michel Rommens, Chevreuse, both of France

[73] Assignee: Commissariat a l'Energie Atomique, Paris, France

[22] Filed: July 9, 1974

[21] Appl. No.: 486,877

[30] Foreign Application Priority Data

July 18, 1973 France ..... 73.26289

[52] U.S. Cl. ..... 299/8; 37/56; 37/61; 37/72; 37/DIG. 8; 37/195; 302/14; 417/54; 417/108

[51] Int. Cl.² ..... E02F 3/88; E02F 7/00

[58] Field of Search ..... 302/14; 209/250, 268, 209/269; 299/8, 9; 37/56, 58, 59, 72, DIG. 8, 195, 60, 61, 62; 417/54, 108

[56] References Cited

UNITED STATES PATENTS

| | | | |
|---|---|---|---|
| 3,010,232 | 11/1961 | Skakel et al. | 37/195 |
| 3,160,966 | 12/1964 | Skakel et al. | 37/69 X |
| 3,429,062 | 2/1969 | Nelson | 37/72 X |
| 3,456,371 | 7/1969 | Graham et al. | 37/72 X |
| 3,504,943 | 4/1970 | Steele et al. | 299/8 |
| 3,620,572 | 11/1971 | Krutein | 299/8 |
| 3,693,272 | 9/1972 | Gariel | 302/14 X |
| 3,731,975 | 5/1973 | Lindelof | 299/8 |
| 3,763,580 | 10/1973 | Kuntz, Jr. | 37/61 |
| 3,815,267 | 6/1974 | Laarman | 302/14 X |
| 3,857,651 | 12/1974 | Bruno | 37/61 X |

FOREIGN PATENTS OR APPLICATIONS

| | | | |
|---|---|---|---|
| 273,328 | 6/1951 | Switzerland | 37/60 |
| 1,243,615 | 8/1971 | United Kingdom | 37/DIG. 8 |
| 1,159,336 | 7/1969 | United Kingdom | 299/9 |

*Primary Examiner*—Clifford D. Crowder
*Attorney, Agent, or Firm*—Lane, Aitken, Dunner & Ziems

[57] ABSTRACT

In a first step, a mixture of nodular sediments and sea water is collected by dredging along the sea bed and lifted into the separation compartment of an underwater control and storage station connected by tubing to a carrier ship. A volume of air corresponding to the pressure of the compartment at the immersion depth is sucked from the mixture and re-injected into the dredging tube by means of a booster compressor. In a second step, the nodules separated from the air are sucked to the surface and then collected.

11 Claims, 3 Drawing Figures

METHOD OF EXTRACTION OF NODULAR SEDIMENTS OR THE LIKE FROM THE SEA FLOOR AND AN INSTALLATION FOR CARRYING

This invention relates to a method of extraction of nodular sediments or the like from the sea floor and to an installation for carrying out said method.

The nodular sediments or alternatively the nodules which it is desired to extract from the sea floor are anchored at variable depths. They essentially contain manganese and also other metals such as iron, nickel, molybdenum, cobalt and copper. They accordingly constitute an inexhaustible source of highly desirable ores and many exploitation processes and devices have already been proposed.

Some of these processes make use of pumps which draw the mixture of nodules and sea water into a chamber and transfer the nodules into the bunkers of an ore carrier ship.

Other methods make use of a lifting system based on the injection of air into the tube containing the mixture to be raised to the surface. The air bubbles produced lighten the mixture and entrain this latter within the lifting tube in much the same manner as a pumping operation.

In another known method, the mixture is delivered into a pressurized chamber at the level of the sea surface but this calls for the use of a lock-chamber for removing the nodules at atmospheric pressure and therefore complicates the process.

A study of lifting by injection of air has led to the following observations:

Progressively as it travels upwards to the surface, the volume of air increases under the action of a reduction of pressure and this increase is very substantial in the last few meters of the upward travel since the volume doubles within the last 10 meters.

There also exists a limiting value in regard to the volume rate of flow of air and a change in the nature of the flow occurs above this value. Any increase in the volume rate of flow of air above this limit makes a progressively smaller contribution to the pumping and constitutes a loss of energy.

The invention is directed to a method of extraction of nodular sediments or the like from sea beds which consists in placing on the sea floor in a predetermined site location a movable collecting vehicle which is intended to extract the nodules by mixing them with a quantity of water which is necessary for washing and conveying them to the surface, in carrying out a first ore crushing treatment, in causing the suction of the mixture of nodules and of the water by injecting air into a dredging tube, in collecting said mixture in surface ore-carrier ships, said method being characterized in that it consists in a first step in directing the mixture into a separation compartment which is open to the sea so as to ensure that its pressure is equal to the pressure of the sea at the depth at which it is immersed, said separation compartment being provided within the interior of a control and storage station immersed at a depth which can attain over 100 meters so that a volume of air corresponding to the pressure at said depth is sucked from the mixture and then re-injected into the dredging tube by means of a booster compressor and, in a second step, the nodules separated from the air are sucked upwards to the surface and then collected.

By collecting the mixture at a depth of 40 meters, for example, it can be established that, in the case of a volume of air $V_1$ injected from the surface of the sea to a depth of 3000 meters, the expanded volume at 40 meters is 60 $V_1$ whereas it would only be 300 $V_1$ at the surface of the water. There is therefore obtained an expansion ratio which is five times smaller than if the collection were carried out directly at the surface.

The invention is also directed to a station for controlling and storing nodular sediments or the like obtained from the sea floor, said station being intended to be immersed and characterized in that it essentially comprises a separation compartment having a bottom portion open to the sea and a separation chamber in which a pipe for supplying a mixture of nodules, water and air to be separated opens into a separator which retains the nodules in a storage zone, a booster compressor which ensures on the one hand a suction and re-circulation of the air which has been drawn up and on the other hand an injection of air into emulsifiers provided in a tube for lifting the mixture.

A zone for storage of nodules is provided within the separation compartment, said nodules being drawn up to the surface by a loading pump.

By thus directing the mixture into the separation compartment at a pressure which is higher than atmospheric pressure, the expansion of the air is accordingly reduced, thereby preventing the appreciable loss of power which is inherent in conventional methods of direct discharge to the surface by injection of air. Since the interior of said separation compartment is at the same pressure as the pressure of the surrounding water, its structure does not need to be designed to afford resistance to large pressure differences and there is no need to provide a lock-chamber for delivering the mixture to the surface.

Provision can be made for a pipe which serves to connect the station to the surface for the supply of make-up quantities of air.

The station is connected to a collecting vehicle by means of a tube constituted by elements attached to each other by interengagement. Said tube is connected to the collecting head by means of an articulation.

A ballast-weight serves to ensure good verticality of the tube at least over the length of pipe in which the air is injected.

Further properties and advantages of the invention will become apparent from the following description of a particular embodiment of the method and of the control and storage station which is given by way of explanatory illustration with reference to the accompanying drawings, wherein.

Figure 1:
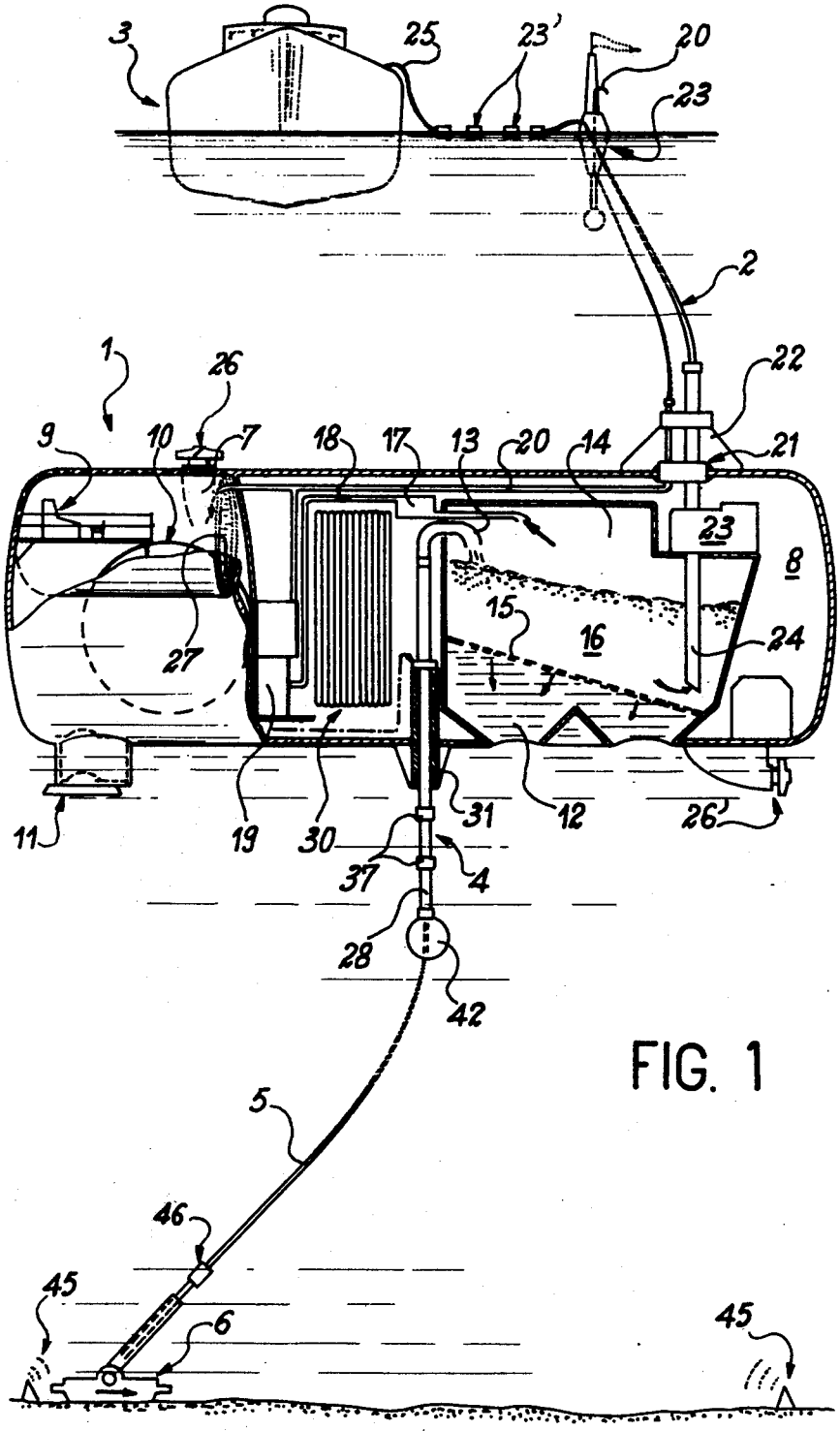
FIG. 1 is a general view of the installation.
Figure 3:
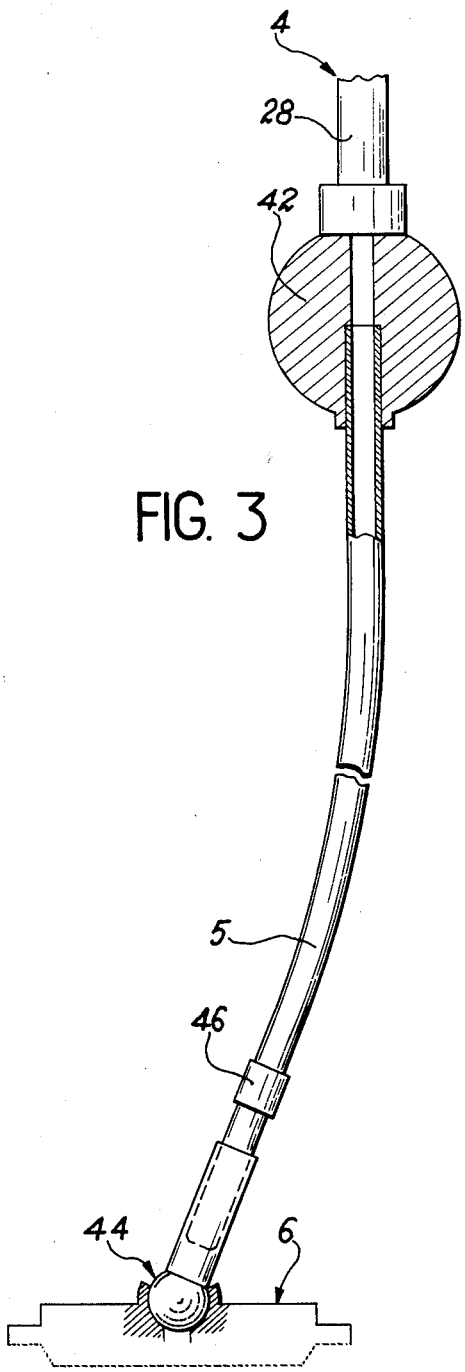
FIG. 3 shows the inclined dredging tube and the system adopted to couple said tube to the collecting vehicle.

In the general view of the installation which is given in FIG. 1, there can be seen an underwater station 1, the top portion of which is connected to an ore carrier ship 3 by means of a tube 2 and the bottom portion of which is connected to a collecting vehicle 6 by means of a dredging tube comprising a vertical tube 4 and an inclined tube 5.

The underwater station 1 which is employed for controlling the operation of the different elements of the installation and especially for storing the collected nodules comprises a control compartment 7 which is maintained at atmospheric pressure, a control room 9 from which it is possible in particular to follow the displacement of the collecting vehicle 6 on a television screen and to control the displacement of said vehicle, and a power production unit 10. The control room is provided with a manhole and a lock-chamber 11 for the relief of the crew and food supplies.

The station 1 further comprises a separation compartment 8 which performs an essential function and is not at atmospheric pressure since it is open towards the sea through an inlet 12 provided on the bottom of said compartment. Delivery of the mixture of nodules extracted from the sea bed, of the transporting water and of the lifting air is carried out by means of an elbowed tube element 13 which opens into a separating chamber 14 above a grid 15 which prevents the nodules from passing through and, as a result of its inclination, facilitates the collection of nodules in a storage zone 16, whereas the transporting water is returned into the sea and the lifting air is sucked into the top of the compartment 8 through a filter 17 which is connected by means of a tube 18 to a booster compressor 19 which delivers air into the vertical tube 4 through a duct (not shown). The pipe 20 is elbowed at the level at which it passes through the opening 21 formed in the top wall of the compartment 8. A support bracket 22 fixed on each side of the opening 21 maintains the pipe 20 in a vertical position until it penetrates through a supporting buoy 23, then passes out in free air above sea level. Said pipe 20 is flexible over that part of its length which forms a connection between the storage reservoir and free air. The pipe serves on the one hand to supply air to the control room and to the power production unit and on the other hand to supply the necessary make-up quantities of air to the booster compressor by reason of the inevitable losses at the moment of separation, of various leakages and of the consumption of the ballast-tank system.

The flexible tube 2 which is also supported by the bracket 22 is connected to a loading pump 23 fixed on a frame provided above the storage zone 16 and fitted with a suction tube 24, the head of which penetrates to the bottom of the storage zone in order that this latter may be completely emptied if necessary. The flexible tube 2 also passes inside the buoy 23 and is supported at the surface of the sea by a number of small buoys 23' in such a manner as to ensure that the tube extremity 25 is continuously accessible and can be connected to the top level of the bunker of the ore carrier ship 3. This flexible connection permits continuous loading of the carrier ship even under bad weather conditions. The delivery of the loading pump 23 is higher than the rate of pumping by injection of air in order to take account of stoppages caused by changes of carrier ships.

Raising and lowering of the station are carried out in known manner by means of engines with screw-propellers such as those designated by the reference 26 and 26', which are associated with two ballast-tanks 27 mounted at the top and on the walls of the station. Filling with water and emptying of said ballast-tanks are controlled as a function of the storage of nodules from the control room 9.

Figure 2:
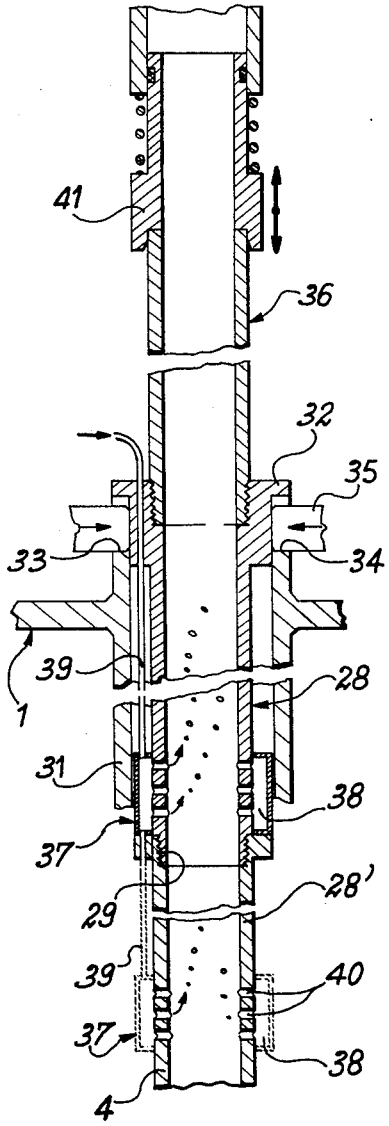
FIG. 2 shows diagrammatically and in detail the mode of assembly of the tubular elements which constitute the vertical dredging tube.

The tube 4 is formed by the assembly of tubular elements 28 which are stored in a reserve compartment 30. Downward displacement of the tubular elements 28 is carried out through the well 31 which can be seen at the bottom of the compartment 8. Each tubular element 28 is hollow and provided with an externally threaded end 29 which can be screwed into the internal bore placed at the other end of a following element 28'. The assembly shown in FIG. 2 is thus obtained. In order to prevent the last element 28 from falling into the well after coupling with the other elements, said last element is provided with a circular flange 32 of sufficient width to rest on the rims 33, 34 of the well.

A circular jaw 35 can be engaged around the head of an element and permit attachment of this latter by screwing either with another element or with a retractable union sleeve 36. Three of the tubular elements are equipped with an emulsifier 37 comprising an annular chamber 38 to which is connected a tube for the supply of hot air, said tube being in turn connected to the booster compressor 19. At the level of each chamber, the wall of each tubular element is provided with openings 40 which constitute a corresponding number of passages for the air which is injected under pressure from the control station. The retractable union sleeve 36 is maintained in position under the action of a telescopic socket-tube 41. The emulsifiers 37 are located at different depths in order to start-up the pumping operation progressively, beginning with the uppermost emulsifier.

The connecting tube 5 between the collecting vehicle 6 and the tube 4 has a mean density which is close to that of the water in order to reduce the mechanical effects and to minimize the power which is necessary for the displacement of the collecting vehicle.

Said tube is usually made of steel and provided with floats if necessary. A ballast-weight 42 can be secured to the end of the tube 4 at a depth which permits sufficient displacement of the collecting vehicle so as to maintain good verticality of said tube 4. The station being thus fixed in position, the collecting vehicle can sweep a zone several hundred meters in amplitude in the case of a connection between the tubes 4 and 5 located at a height of approximately 1000 meters above the sea floor. The tube 5 can be rigid, may or may not be telescopic, or else the tube can be flexible. The collecting vehicle 6 is provided with a propulsion system (not shown) which enables it to move in both directions; collection of nodules or sediments is carried out in each of these two directions of travel. Power is supplied to the vehicle by means of an electric cable connected to the control station from which the collecting vehicle is controlled. Said vehicle is equipped with mechanisms for collecting, washing or brushing the nodules and in some instances even for crushing these latter, for injecting said nodules at the base of the lifting tube 5. The rate of flow of nodules is adjusted from the control station by controlling the speed of the collecting vehicle or by producing action on the rates of crushing and transportation of the nodules in the collecting vehicle 6.

In each position of the station, the vehicle sweeps a strip of sea-floor which is indicated by marker beacons. The installation is designed to lift several thousand tons to the surface per day and sweeping of the sea bed by the collecting vehicle is performed in round trips while the station travels slowly so as to follow a route corresponding to the center of the transverse amplitude of displacement of the collecting vehicle along the sea bed. This ensures that the station travels at a very low speed and further ensures low expenditure of energy for pulling the tubes 4 and 5.

A regulating system 46 connected to instruments for measuring the density of the mixture of nodules and of sea water which passes through the tube 5 can initiate the opening of a valve in order to prevent clogging of the tube and in order to adjust the ore concentration.

It is readily apparent that the embodiment which has been described in the foregoing has been given solely by way of explanatory illustration and that numerous modifications and variations could be added thereto by anyone versed in the art without departing either from the scope or the spirit of the invention. In particular, the system for lifting by injection of air could be replaced by or associated with a pumping unit of conventional type. The different elements of the installation can also be controlled at will by means of electrical, mechanical or hydraulic connections.

What we claim is:

1. An underwater station for collecting ore particles of a predetermined minimum size from sea beds, comprising a compartment adapted to be submerged and having a portion open to the sea for maintaining the compartment at the same pressure as the surrounding water, separating means for retaining in the compartment particles above the predetermined minimum size and returning to the sea particles below the predetermined minimum size, pipe means for supplying ore particles to the separating means, the pipe means including suction means for creating a lifting force so that a combination of ore particles and sea water are lifted from the sea bed into the compartment, the suction means including a plurality of openings in the pipe means through which gas under pressure can be injected for providing the lifting force, the suction means further including a compressor for supplying gas under pressure to the plurality of openings, and underwater recirculation means for recirculating to the compressor a substantial quantity of gas which has already been circulated through the pipe means and into the compartment and which is subjected to the pressure of the surrounding water between the time it leaves the pipe means and until it enters the compressor.

2. A station according to claim 1, wherein said compartment further comprsies a control section which is maintained at atmospheric pressure and which includes a control room and a power production unit.

3. A station according to claim 1, wherein the separating means comprises a grid which prevents the ore particles of a predetermined minimum size from passing through said grid and which is inclined at an angle so as to facilitate the collection of particles.

4. A station according to claim 1, wherein provision is made within the compartment for a nodule storage zone from which the nodules are sucked to the surface by means of a loading pump.

5. A station according to claim 1, wherein said station is equipped with engines having screw-propellers and ballast-tanks.

6. A station according to claim 1, and further including a second pipe means for supplying air from the surface to the compressor.

7. A station according to claim 1, wherein said station is connected to a collecting vehicle by means of a lifting tube and by means of an inclined tube.

8. A station according to claim 7, wherein the lifting tube is constituted by tube elements which are attached to each other by interengagement and held in position by a ballast-weight.

9. A station according to claim 7, wherein the dredging tube is attached to the collecting vehicle by means of an articulated assembly vertically disposed.

10. A method of collecting ore particles of a predetermined minimum size from sea beds comprising the steps of:

a. submerging a compartment capable of separating and retaining therein particles above the predetermined minimum size and returning to the sea particles below the predetermined size;

b. maintaining the compartment at the same pressure as the surrounding water;

c. injecting gas under pressure into a pipe means along the length thereof for providing a lifting force for sucking ore particles and sea water through the pipe means and into the compartment;

d. recirculating through a compressor to the pipe means gas which has already been circulated through the pipe means and into the compartment;

e. subjecting the recirculated gas to the pressure of the surrounding water from the time it leaves the pipe means and until it enters the compressor.

11. The method in claim 10, wherein the step of submerging includes the step of maintaining the compartment at a depth of greater than 100 meters.

* * * * *